US005160800A

United States Patent [19]

Travor et al.

[11] Patent Number: 5,160,800

[45] Date of Patent: Nov. 3, 1992

[54] OBTURATOR RETAINING MEANS

[75] Inventors: Bruce W. Travor, Holland; Frank P. Marshall, Penns Park; Timothy L. Kraynak, Hatboro, all of Pa.

[73] Assignee: The United States of America as represented by the Secretary of the Navy, Washington, D.C.

[21] Appl. No.: 691,583

[22] Filed: Apr. 24, 1991

[51] Int. Cl.[5] ..... F41A 1/00

[52] U.S. Cl. ..... 89/1.57; 89/1.51; 102/357; 102/393; 102/489; 102/505; 102/532; 244/137.1

[58] Field of Search ..... 89/1.51, 1.56, 1.57, 89/1.816; 102/340, 342, 351, 357, 393, 430, 440, 489, 505, 532; 244/137.1, 137.4

[56] References Cited

U.S. PATENT DOCUMENTS

| | | | |
|---|---|---|---|
| 3,430,533 | 3/1969 | Kifor et al. | 102/505 |
| 3,712,224 | 1/1973 | Hanzel | 102/357 |
| 4,026,188 | 5/1977 | Woodruff et al. | 89/1.51 |
| 4,466,332 | 8/1984 | Van Sloun | 102/505 |
| 4,474,101 | 10/1984 | Boulard et al. | 102/505 |

FOREIGN PATENT DOCUMENTS

| | | | |
|---|---|---|---|
| 2169067 | 7/1986 | United Kingdom | 244/137.4 |

*Primary Examiner*—Harold J. Tudor
*Attorney, Agent, or Firm*—James V. Tura; James B. Bechtel; Susan E. Verona

[57] ABSTRACT

An improved store launching device is disclosed wherein the inside of a standard sonobuoy launch container is modified to accept, and properly dispense, only one smaller and lighter store. A positioning ring is fitted securely onto the inner walls a preselected distance from the discharge end to provide a seat for a perforated obturator. A slotted pressure relief ring, with the edge adjacent the obturator having a biased cut of a predetermined angle therein, is placed adjacent the obturator and the discharge end of the container to surround the store.

10 Claims, 2 Drawing Sheets

FIG. 1
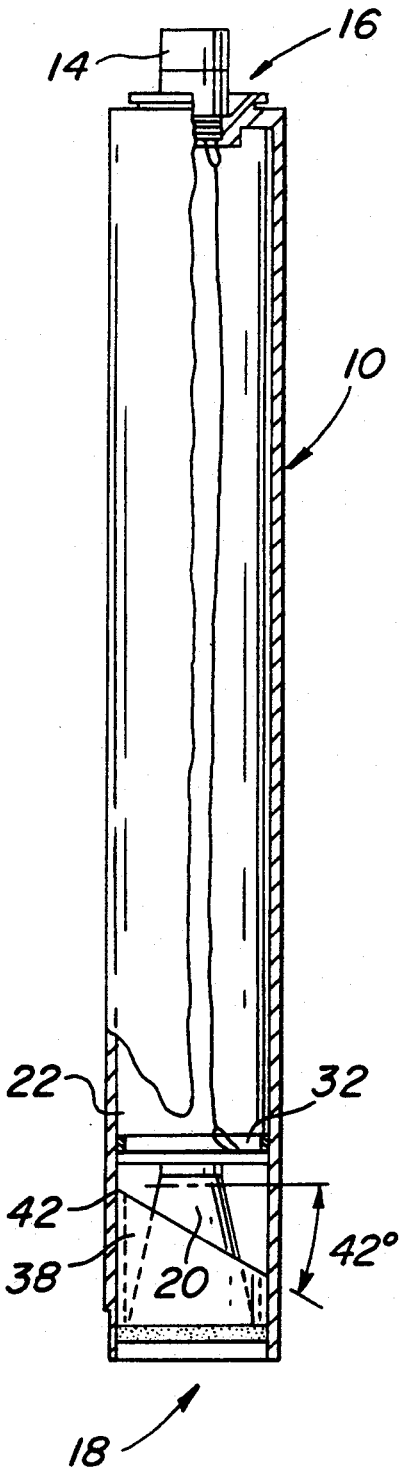
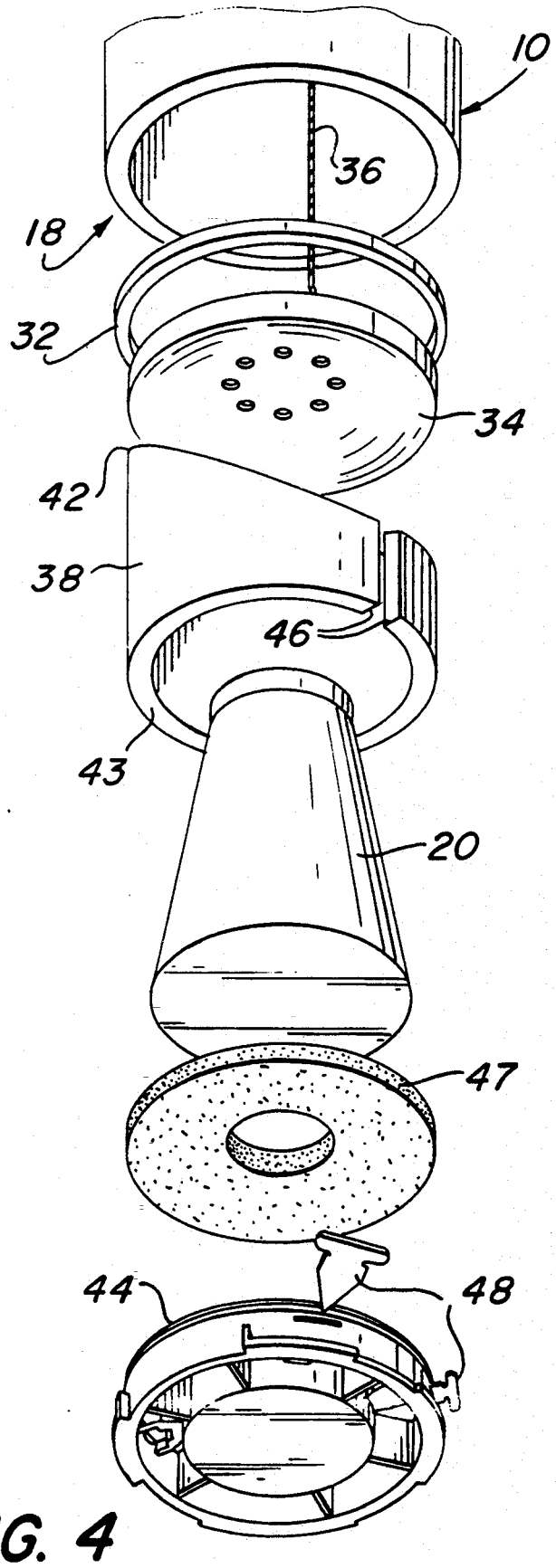
FIG. 4

OBTURATOR RETAINING MEANS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention discloses an improved store launcher that can be used to launch a single, lightweight store at a controlled, preselected velocity. Advances in technology have led to the micro-miniaturization of most electronic components, and to a down-sizing of items such as sonobuoys, and other types of stores, that carry these components and are launched from an aircraft. Although the size of the actual stores has decreased, problems still existed with the compatibility between the newer, smaller stores and the standard-size launcher. This was especially true where these launchers were receiving their gas pressure forces from the actuation of a standard-size CAD (cartridge actuated device); the amount of force generated would be too great. Also, with the discharge of the store itself, there most always would be additional debris in the form of the obturator that was used to position the store in the launcher, shot out of the launcher, debris that could impact the aircraft and cause injury.

SUMMARY OF THE INVENTION

Accordingly, it is an object of the present invention to provide an improved launcher device that operates inside a standard launch container and allows controlled release of a single store.

It is another object of the present invention to provide an improved launcher device that operates inside a standard launch container and allows controlled release of a single store by restricting the flow of gas pressure.

It is still another object of the present invention to provide an improved launcher device that operates inside a standard launcher that minimizes the amount of debris that exits the launcher with each store.

These and other objects and many attendant advantages of the present invention are obtained where an improved store launching device is placed inside a standard launch container to control and restrict the flow of launch gas pressure and minimize the launch debris that exits the container. The improvement comprises a first, positioning ring that is fitted against the inner walls a preselected distance from the discharge end of the container to provide a seat for a perforated obturator. A second, pressure relief ring, having an angled or slanted inside end and a squared-off outer end, is placed around the store adjacent the first ring and, optionally, a stranded steel braided wire attached to the inner side of the obturator. Upon firing of the store, the gas forces released at the breech end force the obturator against the slanted edge so as to allow a predetermined amount of gases to blow by, thereby releasing or launching the store with a lesser amount of force.

BRIEF DESCRIPTION OF THE DRAWINGS

FIG. 1 shows a longitudinal view of a launch container with the outer skin partially broken away to show the instant invention therein;

FIG. 4 shows an exploded view of the parts of the invention as they sit inside the container.

DETAILED DESCRIPTION OF THE PREFERRED EMBODIMENT

Figure 2:
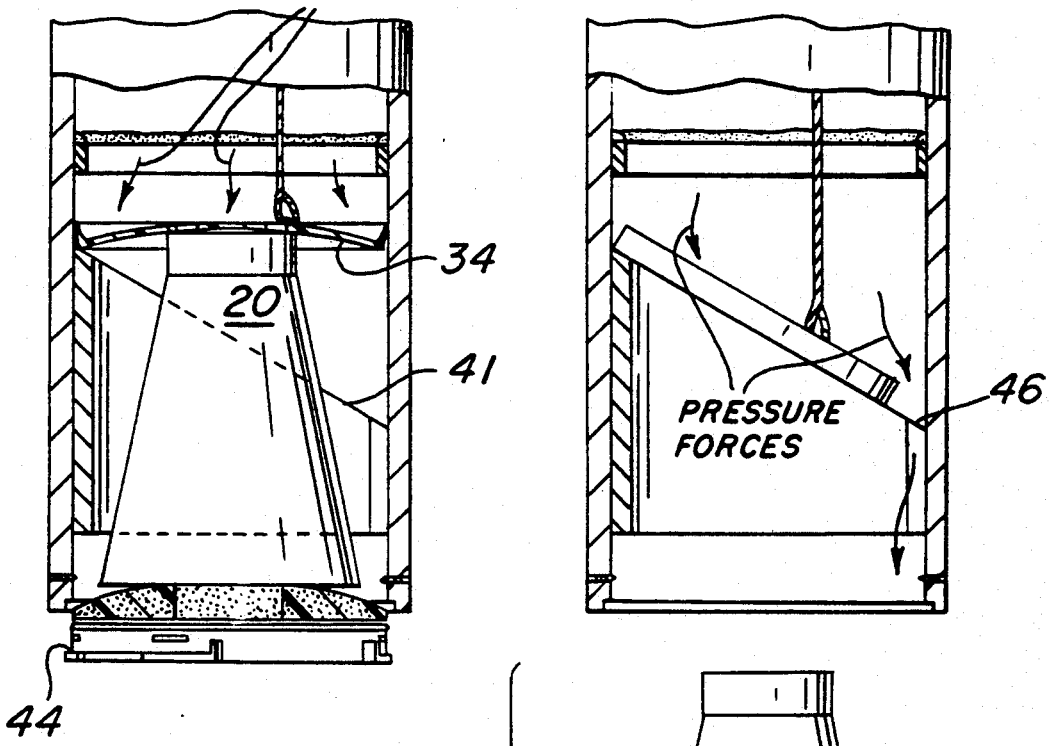
FIG. 2 shows an isolated view of the discharge end 18 of the launch container of FIG. 1 with the outer shell of the container broken away, immediately after a pressure force has impacted the device.

Conventional store launchers, such as for instance sonobuoy launch containers, have no means to accommodate substitution of smaller sized stores, that require a lesser launching force. Nor do they have a way of preventing the obturator, a cushion-like device usually placed adjacent each store or buoy, from being forced out of the launcher. In these instances, when launching small buoys that are positioned near the discharge end of the launcher, because of the standard gas pressure forces, the obturator breaks free from its attachment point, such as a shelf inside the container, and exits into the airstream to possibly damage the aircraft. Also, the store can be damaged by these forces. Or, in cases when a lanyard is attached between the breech end, near the CAD, and the obturator to prevent loss of the obturator, this lanyard will fail by being burned from the hot gases from the CAD or the forces generated will pull it apart from its connection point.

The instant invention, a pair of obturator retaining rings positioned on either side of the obturator, can be used without an obturator retaining lanyard, or with such a lanyard, as shown in FIG. 1. As more fully shown in FIG. 4, an exploded view of the discharge end 18 of a standard, or conventional, launcher 10, the invention comprises an inner retention ring 32, with optional stranded steel braided wire lanyard 36, and an outer pressure relief ring 38. These parts remain inside the container at all times and are only shown in this exploded view for clarity. A smaller-than-normal buoy 20 with obturator 34 are also shown in FIG. 4.

As shown more clearly in FIG. 1, a longitudinal view of the standard launch container 10, which uses a standard pyrotechnic device, such as a CAD (cartridge activated device) 14 at the breech end 16, inner ring 32 is a fixed shelf 22 placed a predetermined distance from the upper-most edge 42 of pressure relief ring 38. Pressure relief ring 38 is formed from a tube, initially shaped as a right circular cylinder, that has a biased cut of approximately 42 degrees taken out of one end, the inner-most end, to form a slanted edge 41 (as seen in FIG. 2) for a purpose to be described. Ring 38 is a tube-like device sized to conform to, and fit inside of, the inner walls of container 10 and yet have a large enough circumference to surround buoy 20 so as not to interfere with the exit thereof. The inner diameter of the edge of ring 38 is smaller than the circumference of obturator 34. In a similar manner, the inner diameter of ring 32 is also smaller than the circumference of obturator 38, so as to trap obturator 34 between the two rings. Pressure relief ring 38 additionally carries a slot 46 longitudinally throughout the shortest section thereof. Slot 46 can be of a predetermined width, as will be described, and extends from the lowest spot of slanted edge 41 to the oppositely-disposed, flat edge 43.

This invention provides for positive retainment of obturator 34 before, during and after launching of a smaller-sized store 20, such as a small sonobuoy. By placing upper retention ring 32 above (or closer to the breech end of container 10) obturator 34 and pressure relief ring 38 below obturator 34, obturator 34 and store 20 are initially prevented from translating, or moving, towards breech end 16 during any handling, transportation or loading of container 10. Furthermore, specific placement of ring 32 a predetermined distance removed from edge 42 of ring 38 determines a stroke length (or standoff distance) and velocity of obturator 34 and store 20. This can be predetermined according to the size and weight of store 20.

Figure 3:
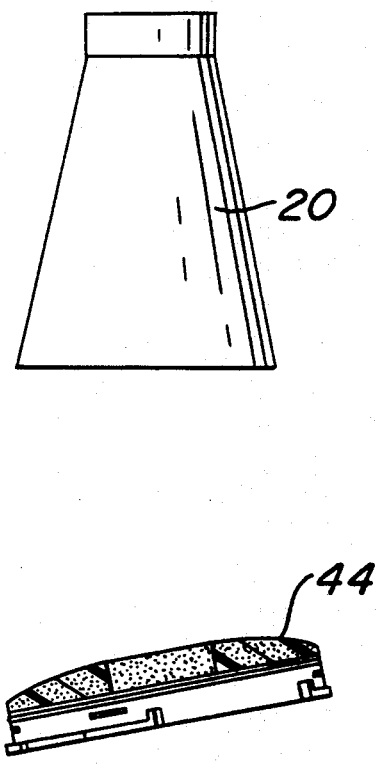
FIG. 3 shows an isolated view, similar to FIG. 2, after the store and end cap have exited the container.

Upon initiation of the launch sequence, as shown in FIGS. 2 and 3, CAD 14 is activated by means known in the art and produces pressure which builds inside container 10. The pressure is depicted in FIGS. 2 and 3 by wavering arrows. The pressure forces obturator 34 and store 20 to push against a foam pad 47 and end cap 44 until a plurality of shear pins 48, as known in the art, fracture to release the components. Once pins 48 are severed, obturator 34 pushes against store 20 and accelerates it until obturator 34 contacts pressure relief ring 38. By the biased or slanted edge 41 of ring 38, obturator 34 will tip (as seen in FIG. 3) and allow the chamber pressure to vent past the lowest side of obturator 34 and through slot 46. The pressure relief ring 38, in addition to its function of pressure regulation, also serves to retain obturator 34 inside of container 10 and to provide lateral stability to store 20 during its exit from container 10. Additional pressure regulation can be achieved, if necessary, by boring one, or several, holes (as shown) in obturator 34.

Although no retention lanyard is needed with the instant invention, an alternate embodiment may use one. Rings 32 and 38 may be made from lightweight cardboard or the like and may be coated with fire retardant and water absorption prevention chemical substances, as known in the art. Variations of store velocity, length, weight or outer diameter can be compensated for by adjusting the obturator stroke length, angle of biased cut or configuration of retention means.

Finally, while the obturator retention means has been described with reference to a particular embodiment, it should be understood that the embodiment is merely illustrative as there are numerous variations around modifications which may be made by those skilled in the art. Thus, the invention is to be construed as being limited only by the spirit and scope of the appended claims.

What we claim is:

1. An improved store dispenser for launching a store at a preselected velocity having a tubular launch container with a cartridge-activated device to produce a source of gas at a breech end and a circular end cap at a discharge end, the improvement comprising:

upper retention means attached at a prespecified location to an inner container wall to provide an inner stopping point;

obturator means adjacent said retention means to receive gas pressure forces; and tubular section pressure relief means adjacent said obturator means at a predetermined distance to provide an escape path for excess gas pressure forces, said tubular section pressure relief means having a bias cut portion facing said obturator means.

2. An improved store dispenser as described in claim 1 wherein said upper retention means is a ring of predetermined diameter.

3. An improved store dispenser as described in claim 1 wherein said obturator means is a disc of predetermined thickness.

4. An improved store dispenser as described in claim 1 wherein said tubular section pressure relief means comprises a right circular cylindrical tube section with an inner-most end and a longitudinally-extending slot cut through a remaining portion.

5. An improved store dispenser as described in claim 1 wherein said obturator means includes an obturator retention lanyard connected between said obturator and the breech end.

6. An improved store dispenser as described in claim 3 wherein said obturator means includes perforations in said disc.

7. An improved store dispenser as described in claim 5 wherein said lanyard is braided steel wire.

8. An improved store dispenser for launching a store at a preselected velocity having a tubular launch container with a cartridge-activated device to produce a source of gas at a breech end and an end cap to act as a retaining means removably secured at a discharge end, the improvement comprising:

an inner retention ring for securing onto inner walls of the container at a predetermined distance from the discharge end;

a perforated disc positioned adjacent said ring and connected to the breech end by a lanyard; and a pressure relief ring adjacent the end cap and said disc, said relief ring having a tubular shape with a longitudinal slot therein and a bias cut portion facing said perforated disc.

9. A tubular store dispenser comprising:

a. a tubular launch container having at one end gas generating means and an end cap at the oppositely disposed end;

b. a ring of predetermined diameter attached at a prespecified location adjacent said end cap to an inner container wall;

c. a disc of predetermined thickness immediately adjacent said ring; and d. a tubular, right circular section with an inner-most end having a bias cut portion and a longitudinally-extending slot cut through a remaining portion.

10. A tubular store dispenser as described in claim 9 and including a lanyard connecting said disc to said dispenser.

* * * * *

UNITED STATES PATENT AND TRADEMARK OFFICE

CERTIFICATE OF CORRECTION

PATENT NO. : 5,160,800

DATED : November 3, 1992

INVENTOR(S) : David A. Andersen, Keith A. Kiefer, Leonard D. Hones

It is certified that error appears in the above-identified patent and that said Letters Patent is hereby corrected as shown below:

Column 5, line 39 cancel "an" and substitute —and—.

Column 5, line 45 cancel "of" in the second occurrence and substitute —by—.

Column 6, line 42 cancel "an" and substitute —and—.

Signed and Sealed this

Twelfth Day of October, 1993

Bruce Lehman

*Attest:*

BRUCE LEHMAN

*Attesting Officer*

*Commissioner of Patents and Trademarks*